United States Patent [19]

Hodgdon

[11] Patent Number: 4,871,208

[45] Date of Patent: Oct. 3, 1989

[54] CHAIR TILT CONTROL MECHANISM

[76] Inventor: Dewey Hodgdon, 48 Forster Rd., Manchester, Mass. 01944

[21] Appl. No.: 241,074

[22] Filed: Sep. 6, 1988

[51] Int. Cl.[4] ..... A47C 1/02

[52] U.S. Cl. ..... 297/304; 248/575; 297/302

[58] Field of Search ..... 297/300, 301, 302, 303, 297/304, 325, 326; 248/575–578

[56] References Cited

U.S. PATENT DOCUMENTS

| | | | |
|---|---|---|---|
| Re. 21,857 | 7/1941 | Herold | 248/578 |
| 2,228,719 | 1/1941 | Balear | 297/303 X |
| 3,259,431 | 7/1966 | Gale | 297/303 |
| 3,309,137 | 3/1967 | Wiebe | 297/302 |
| 3,813,069 | 5/1974 | Fletcher | 297/303 X |
| 3,863,982 | 2/1975 | Sandham | 297/302 |

FOREIGN PATENT DOCUMENTS

| | | | |
|---|---|---|---|
| 2432248 | 1/1976 | Fed. Rep. of Germany | 297/301 |
| 303139 | 6/1929 | United Kingdom | 297/300 |
| 482529 | 3/1938 | United Kingdom | 297/303 |

*Primary Examiner*—Peter R. Brown

*Attorney, Agent, or Firm*—Donald N. Halgren

[57] ABSTRACT

A manually adjustable tilt control mechanism for a seat assembly arranged upon a frame support. The tilt control mechanism comprises a resilient block of material adjustably disposed between a pair of plates which are connected by a longitudinally adjustable bolt. Manual rotation of an adjustment knob effectuates compression or decompression of the resilient block between the upper and lower plates. The chain assembly being attached to the upper plate is infinitely tiltable in a full range from front to back and side to side, or any combination thereof, depending upon how much the resiliency of the block is permitted by its compression between the upper and lower plates.

11 Claims, 3 Drawing Sheets

CHAIR TILT CONTROL MECHANISM

BACKGROUND OF THE INVENTION (1) Field of the Invention

This invention relates to chairs, and more particularly to devices to permit adjustment and control of the tilt characteristics of chairs (2) Prior Art Office furniture has only in the last decade or so, become adaptable to the varying needs of their users. Frank Lloyd Wright's three-wheeled chairs for the Johnson Wax headquarters were an example of chair design that was indifferent, if not hostile toward the notion of sitting comfortably.

Office furniture in our service based economy, of necessity, has had to have improvements in chair comfort and simplicity.

An advance in chair design is shown in U.S. Pat. No. 3,259,431 which utilizes a compressible member for releasibly locking a chair structure to a chair base. This concept fails to permit ready manual adjustability to regulate the tilting of the chair structure.

U.S. Pat. No. 3,309,137 discloses a seat with a tilting mechanism. However, no means are disclosed for simple adjustment of the tiltability.

U.S. Pat. No. 3,813,069 shows a chair supported on a resilient pad, the pad having a number of holes drilled into it, so that rotation of the pad may vary the compressibility of the pad. The rocking/tilting is limited only to forward and backward movement, and no means are shown which permits simple manual adjustment thereof.

Another U.S. Pat. No. 3,863,982 discloses a compressible pad, but does not indicate any simple adjustable control thereover.

It is an object of the present invention to provide a simple, easily regulatable, manually adjustable tilt control mechanism, which permits side to side as well as forward to backward tilting, as well a tilting motion in all areas between those quadrants, to permit a full 360 degrees of precessional articulation of the seat surface.

It is a further object of this invention wherein a chair control mechanism permits an infinite amount of adjustability in the tilting capacity of that chair.

BRIEF SUMMARY OF THE INVENTION

The present invention comprises a chair assembly having back and seat portions which are mounted on a lower frame support by an adjustable control mechanism, fully tiltable through 360 degrees.

The tilt control mechanism is disposed on the end of a support arm which extends from the lower frame support.

The tilt control mechanism comprises a resilient pad being supported between a pair of plates, the lower plate being attached to the distal end of the support arm.

The resilient pad may be comprised of varying layers of compressibility and the plates connected by a longitudinally adjustable bolt disposed through a hole in the resilient pad. The hole in the pad may be centrally located, or it may be arranged in a non-central, non-symmetrical location to allow varying articulation of the seat through the resilient pad or block, permitting an infinite tilt adjustment capability of the seat, at any point on either side or at any point on the front or back or combination thereof.

The upper plate has an opening which receives the head of a longitudinally adjustable bolt. A manually rotatable knob or lever, engages the lower end of the bolt, beneath the bottom of the lower plate. The bolt head has tapered side portions which act symbiotically with tapered walls of the hole in the top plate to permit a swiveling therebetween, with a minimum of frictional resistance.

By simple manual rotation of the rotatable knob, the resilient pad may be compressed or decompressed, effectuating an infinite adjustability in the resilience and hence tiltability, from side to side and front to back in a full 360 degree azimuth, of the chair assembly secured thereabove.

By simple rotation of the resilient block about the shaft of the adjustable bolt, the tiltability may be further regulated, depending of course upon the non-symmetry of the shape of the pad, or the non-homogeneity of the compounds comprising the pad. That is, the pad may be comprised of non-parallel layers of material, each layer being of a different material or of compressibility/resiliency factor.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
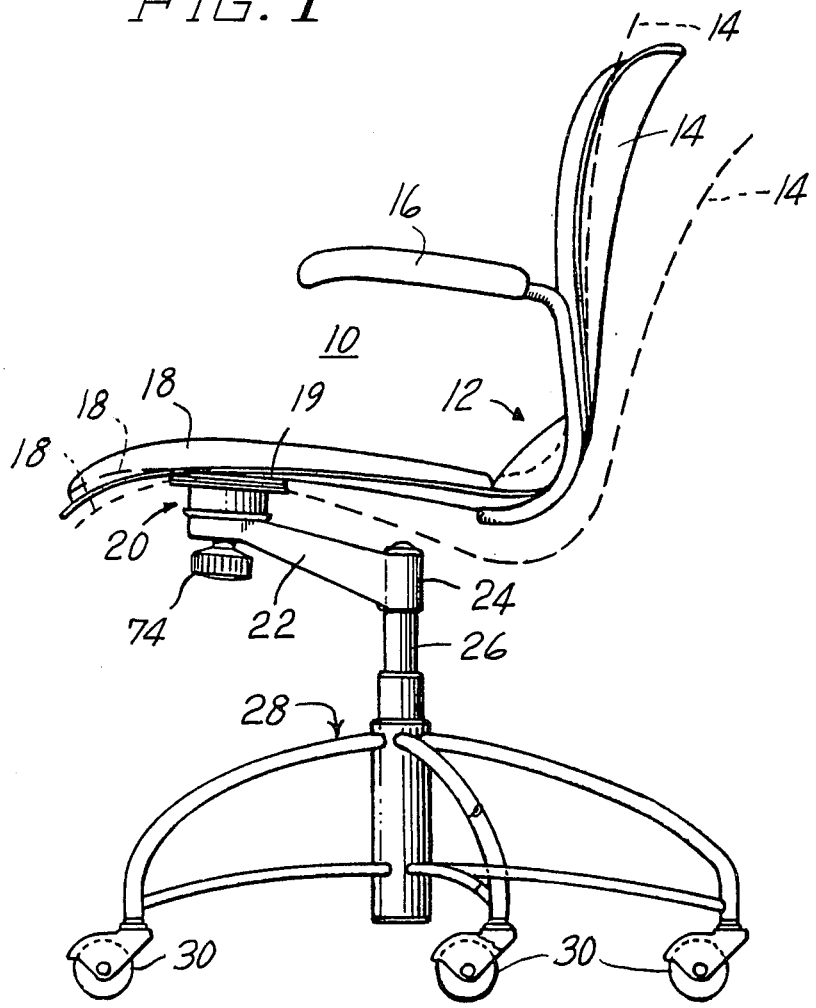
FIG. 1 is a side elevational view of a tiltable chair having a tilt control mechanism of the present invention.

Referring now to the drawings in detail, and particularly to FIG. 1, there is shown a chair assembly 10 comprising a body supporting contoured seat member 12 having a back rest 14 and an arm rest 16, arranged with a seat portion 18.

An arrangement of bosses 19 are disposed on the bottomside of the seat portion 18.

A chair tilt control mechanism 20 is shown in FIG. 1, fixedly disposed on the distal end of a seat member support arm 22. The support arm 22 extends radially outwardly from a housing 24 which mates with a vertically arranged support shaft 26. The support shaft 26 typically telescopically mates with a lower frame 28 having a plurality of wheels 30, to permit the chair assembly 10 to be moved on a floor.

Figure 2:
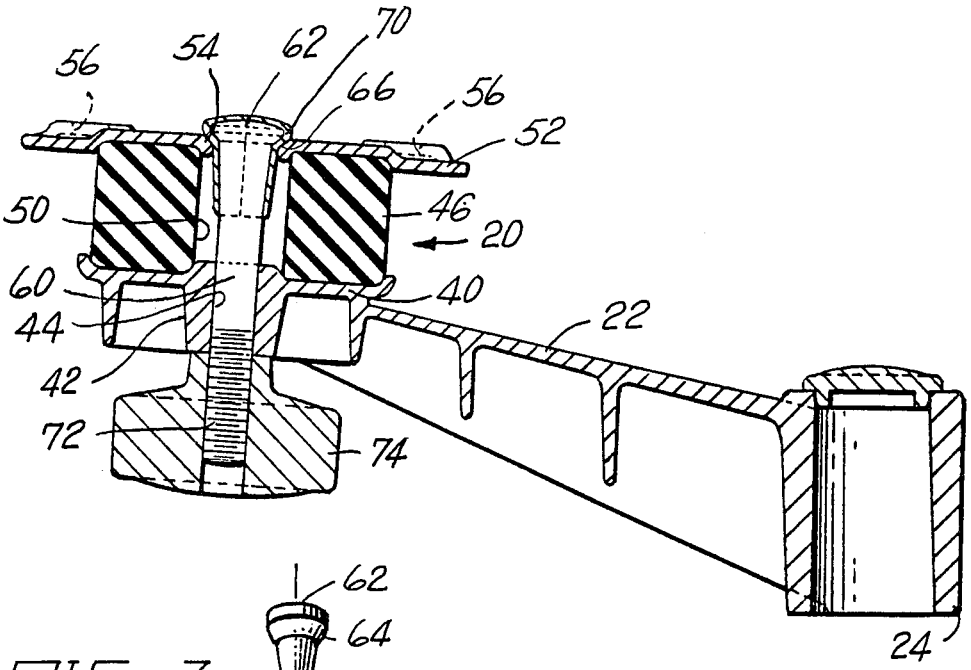
FIG. 2 is a sectional view of the tilt control mechanism on the support arm of a chair.

The tilt chair mechanism 20, as shown in FIG. 2, comprises a lower support plate 40 fixedly attached to the distal end of the support arm 22. The lower support plate 40 has a centrally disposed hub 42 having a smooth bore 44 extending therethrough.

An adjustment means such as a resiliently compressible adjustment pad or block 46 is seated on the lower support plate 40. The adjustment block 46 may be made from a compressible rubber material, or the like. In this preferred embodiment, the compressible block 46 is of torroidal configuration, having a central opening 50 which is arranged to be in axial alignment with the bore 44 in the hub 42.

Figure 4:
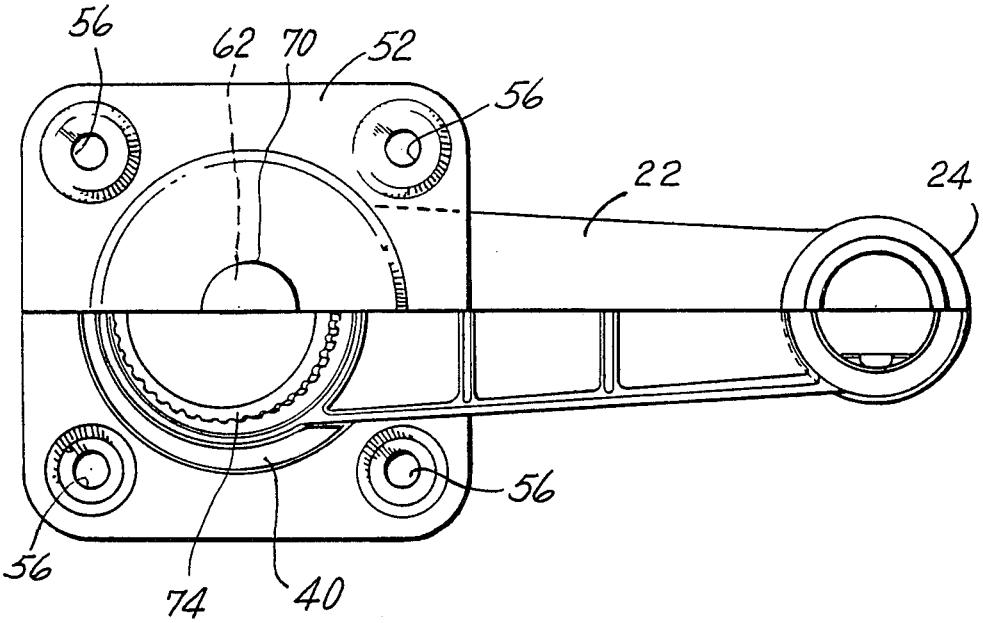
FIG. 4 is a split plan view from the top and the bottom of the mechanism shown in FIG. 2.

A top plate 52 is seated above the resiliently compressible adjustment block 46, as shown in FIGS. 2 and 4. The top plate 52 has a central aperture 54 which also is in axial alignment with the bore 44 in the hub 42. The top plate 52 has corner openings 56 which permit securement of the tilt chair mechanism 20 to the bosses 19 on the bottomside of the seat portion 18, by known means such as threaded fasteners, not shown, or the like. The block 46 is preferrably bonded by known means such as adhesive or the like, to its respective upper and lower plates 52 and 40, to facilitate tension on one side of the block 46 when the diametrical side of the block 46 is in compression.

Figure 3:
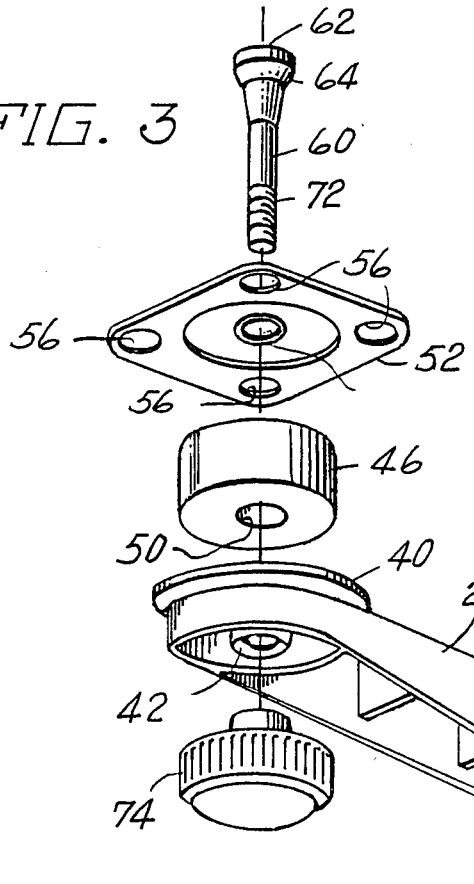
FIG. 3 is an exploded view of the mechanism shown in FIG. 2.

A longitudinally adjustable compression adjustment bolt 60 is arranged through the aperture 54 in the top plate 52, the central opening 50 in the resiliently compressible block 46 and the bore 44 in the hub 42. The adjustment bolt 60 has an enlarged upwardly directed head 62 having inwardly tapering side walls 64, as shown in FIGS. 2 and 3. The aperture 54 in the top plate 52 has a correspondingly tapering edge 66, so as to permit an annular rim of contact between the head of the adjustment bolt 60 and the top plate 52.

The upper end of the adjustment bolt 60 may have a reduced friction covering 70 on it, as shown in FIG. 2, so that the bolt 60 and the top plate 52 may have a slidable, articulable relationship with one another. The covering 70 may be comprised of a layer of Teflon type material (polytetrafluroethylene) or other slippery plastic or metallic material.

The lower end of the adjustment bolt 60 has threads 72 thereon, which threadably receive an adjustment knob 74, as shown in FIGS. 2 and 3.

In operation of the tilt control mechanism 20, rotation of the adjustment knob 74 with respect to the adjustment bolt 60 and the bottom of the hub 42, effectuates longitudinal displacement of the adjustment bolt 60, either compressing or decompressing (permitting expansion) of the resilient block 46.

When the adjustment knob 74 is rotated so as to pull downwardly upon the bolt 60, the resilient block 46 is compressed and thereby made more dense, and concommittantly, harder, thus minimizing its further compressibility or resiliency when forces are directed upon it by the plates 52 and 40, created when someone sits upon the seat member 12. The tiltability of that seat member 12 is thereby restricted and controlled.

When the adjustment knob 74 is rotated so as to release tension upon the bolt 60, the resilient block 46 is permitted to decompress and is thereby made less dense, and concommittantly, softer, thus maximizing its further compressibility or resiliency when forces are directed upon it by the plates 52 and 40, created when someone sits upon the seat member 12. The tiltability of that seat member 12 thereby, is therefore enhanced, by the allowance of at least one side of the resilient block 46, to be compressed and the other side to be somewhat stretched, and thereby placed in tension between the plates 52 and 40.

Figure 3A:
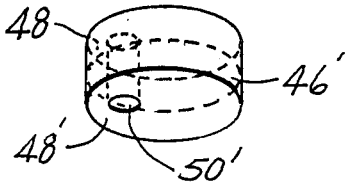
FIG. 3A is a perspective view of an alternative embodiment of the resilient block utilized with this invention.

The resilient block 46 is shown as being circular in plan view (cross-section) with the opening 50 being centrally disposed in its middle. The opening 50' may be in a noncentral location, as shown in FIG. 3A, with the larger mass of the resilient block 46' arranged toward the back of the seat member 12. This would function to further effect the tiltability of the seat member 12 by permitting more compressability towards the rear of the chair assembly 10, and minimizing the stretch or "lifting" decompression of the forward portion of the resilient block 46. Of course the upper and lower plates 52 and 40 would have corresponding receiving "depressions" which would engage any configuration resilient block 46' seated therebetween.

The resilient block 46' may also be comprised of one or more different generally horizontal layers 48 and 48' of material, which layers suggested by the dashed lines across the middle of the block 46' in FIG. 3A, have different degrees of resilience, compressibility and the like. This would permit a greater amount of adjustability.

Figure 5:
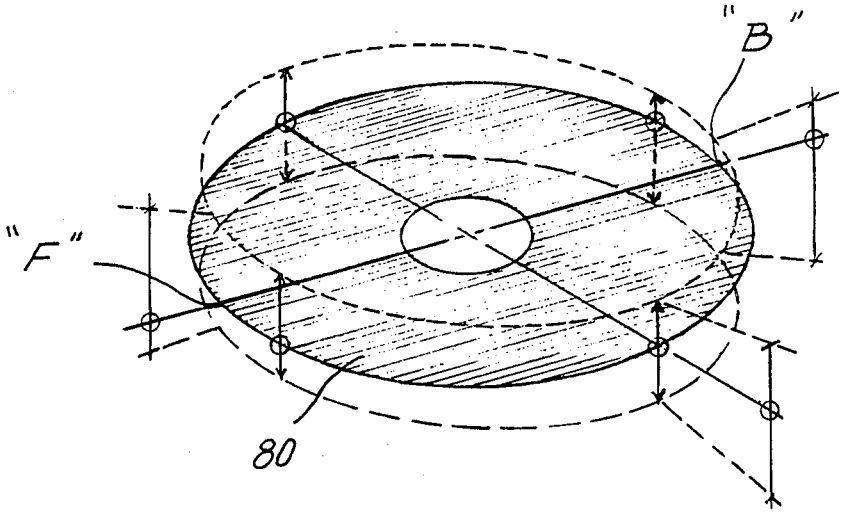
FIG. 5 is a graphical representation, in perspective view, of the limits of tilt, of the upper surface of the seat, or the upper surface of the resilient block.

FIG. 5 shows in perspective view, a graphical representation of the limits of upward and downward tilt, of the general plane of the seat 18. More specifically, the shaded disk 80 could represent the upper surface of the resilient block 46, (or the plane of the seat portion 18), which when pressed rearwardly as at "B", is permitted a tilt of about 20 degrees, the front "F" being permitted concommittantly about a 20 degree lift. That is to say, a person sitting on the seat member 12, and leaning backwardly, would compress the block 46 and also permit about a 20 degree lift to the front edge of the seat member 12. Someone leaning forward on the seat member 12 would compress the block 46 at its forwardmost edge "F" about 5 degrees, and lift the back of the seat member 12 about 5 degrees. A similar condition is permitted in a full azimuth around the sides of the block 46, as represented in the graph of FIG. 5.

Thus what has been shown is a simple, effective manual tilt control mechanism which permits adjustment of the forward, sideward and rearward "tiltability" of a seat secured to the control mechanism. The tilt control mechanism is adjusted by effecting the compressibility of a centrally disposed block which is controllably secured between a pair of parallel plates, the upper plate of which is allowed to rub against the smooth tapered side surfaces of a head of an adjustable bolt. The block may have a central opening or a non-central opening, either in a symmetrical or non-symmetrical configuration, and having uniform homogenous resiliency throughout, or having different layers of various resilient characteristics, as a hard rubber/soft rubber, to permit further variation in the adjustability characteristics when the knob is rotated with respect to the chair.

I claim:

1. A manually adjustable tilt control mechanism for permitting control of the front to back and side to side tilt of a chair assembly on a support frame comprising:

a lower support means extending off of said support frame;

an upper support means arranged on said chair assembly;

a manually adjustable resilient block arranged between said upper and lower support means; said block having an opening which extends therethrough, which opening is eccentrically or non-symmetrically disposed in said block; and a longitudinally movable adjustment means extending through said opening, connecting said upper and lower support means to permit manual variation of the resilience of said block, said block mounted to permit rotational adjustment thereof about said adjustment means, whereupon rotation of said block about said opening permits the varying of compressability characteristics of said block and hence the tiltability of the chair assembly on said upper support means—inserted therefor.

2. A manually adjustable tilt control mechanism as recited in claim 1, wherein said upper support means is connected to said longitudinal adjustment means and is articulable with respect to said longitudinal adjustment means.

3. A manually adjustable tilt control mechanism as recited in claim 2, wherein said upper support means has an orifice with tapered walls which are in engagement with a tapered wall on said longitudinal adjustment means, to facilitate articulation therebetween.

4. A manually adjustable tilt control mechanism as recited in claim 3, wherein said tapered walls have a friction reducing covering to facilitate articulation thereof with respect to said upper support means.

5. A manually adjustable tilt control mechanism as recited in claim 1, wherein said longitudinal adjustment means has a rotatable member thereon to effectuate the variation of the resilience in said block.

6. A manually adjustable tilt control mechanism as recited in claim 5, wherein said rotatable member comprises a threaded knob which threadably receives said longitudinal adjustment member so as to provide or release tension therein, thus compressing and minimising the resilience of said block or decompressing and maximizing the resilience of said block.

7. A manually adjustable tilt control mechanism as recited in claim 1, wherein said block is comprised of a plurality of layers of material, each of said layers being of a varying resilience from any other layer thereassociated.

8. A manually adjustable tilt control mechanism as recited in claim 7, wherein said layers differ in thickness across said block.

9. A manually adjustable tilt control mechanism as recited in claim 1, wherein said block is comprised of a resilient rubber material.

10. A manually adjustable tilt control mechanism as recited in claim 1, wherein said block has upper and lower planar faces thereon, which are non-parallel with one another.

11. A manually adjustable tilt control mechanism as recited in claim 1, wherein the composition of said block is non-homogenous.

* * * * *